US011457702B2

(12) United States Patent
Cipolla

(10) Patent No.: US 11,457,702 B2
(45) Date of Patent: Oct. 4, 2022

(54) EARRING POST

(71) Applicant: Steven A. Cipolla, Warwick, RI (US)

(72) Inventor: Steven A. Cipolla, Warwick, RI (US)

(73) Assignee: National Chain Company, Warwick, RI (US)

( * ) Notice: Subject to any disclaimer, the term of this patent is extended or adjusted under 35 U.S.C. 154(b) by 370 days.

(21) Appl. No.: 16/705,429

(22) Filed: Dec. 6, 2019

(65) Prior Publication Data

US 2021/0169183 A1 Jun. 10, 2021

(51) Int. Cl.
*A44C 7/00* (2006.01)

(52) U.S. Cl.
CPC ..... *A44C 7/001* (2013.01); *A44C 7/002* (2013.01)

(58) Field of Classification Search
CPC ..... A44C 7/001; A44C 7/002; A44C 7/003
USPC ..... 63/12
See application file for complete search history.

(56) References Cited

U.S. PATENT DOCUMENTS

| | | | | |
|---|---|---|---|---|
| 4,307,582 | A * | 12/1981 | Mancini | A44C 7/003 63/12 |
| 4,383,002 | A | 5/1983 | Manolescu | |
| 4,459,829 | A * | 7/1984 | Richard | A44C 7/003 63/12 |
| D340,662 | S | 10/1993 | Cipolla | |
| D340,663 | S | 10/1993 | Cipolla | |
| 5,392,617 | A | 2/1995 | Baldwin | |
| 5,743,113 | A | 4/1998 | Kogen | |
| 5,855,587 | A | 1/1999 | Hyon et al. | |
| D695,642 | S | 12/2013 | Cipolla | |
| D702,584 | S | 4/2014 | Cipolla | |
| D703,577 | S | 4/2014 | Cipolla | |
| 8,904,744 | B1 | 12/2014 | Cipolla | |
| 8,931,251 | B1 | 1/2015 | Cipolla | |
| D755,666 | S | 5/2016 | Cipolla | |
| 9,326,569 | B1 | 5/2016 | Cipolla | |
| 9,451,813 | B1 | 9/2016 | Cipolla | |
| 9,808,055 | B1 | 11/2017 | Cipolla | |
| 9,808,056 | B1 | 11/2017 | Cipolla | |
| 10,040,148 | B1 | 8/2018 | Cipolla | |
| 10,098,423 | B1 | 10/2018 | Cipolla | |
| 10,292,463 | B1 | 5/2019 | Cipolla | |
| 10,299,549 | B1 | 5/2019 | Cipolla | |
| 2009/0007598 | A1 * | 1/2009 | Lei | A44C 7/002 63/26 |

FOREIGN PATENT DOCUMENTS

| | | |
|---|---|---|
| EP | 0 579 400 | 1/1994 |
| WO | 2018/207381 | 11/2018 |

* cited by examiner

*Primary Examiner* — Jack W Lavinder
(74) *Attorney, Agent, or Firm* — Salter & Michaelson

(57) ABSTRACT

An earring post construction that includes an elongated earring post and a cup that is for the support of a decorative piece. The elongated earring post and cup are integrally formed in a single piece construction so as to eliminate the use of any attachment means between the elongated earring post and the cup; in combination with a securing stud that engages with the elongated earring post, and wherein there is provided an elongated passage in the elongated earring post so as to minimize the amount of precious metal used in constructing at least the elongated earring post.

15 Claims, 5 Drawing Sheets

EARRING POST

TECHNICAL FIELD

The present invention relates in general to an earring post construction that is comprised of an elongated earring post and a cup that is adapted for the support of a decorative item. More particularly, the present invention relates to an earring post construction in which the elongated earring post and the cup or pad are integrally formed in a single piece construction so as to eliminate the use of any attachment means between the elongated earring post and the cup.

BACKGROUND OF THE INVENTION

Reference is now made to the prior art diagrams in FIGS. 11 and 12 which illustrate the conventional means by which an earring post is secured with a cup or pad. Both FIGS. 11 and 12 illustrate the post 10 as being a solid post and furthermore illustrate separate respective means for attaching the post 10 with a cup 12. The post 10 is basically staked with or through the pad 12 and soldered in an assembly process. In the embodiment of FIG. 11 at 14 there is illustrated the staking of connection of the post 10 to the cup 12 at an interior surface of the cup 12. Alternatively, FIG. 12 illustrates the securing together of the post and cup at 16 by means of a staking or other form of connection between the posts and an outer surface of the cup 12. In addition to the staking, it is common to provide a soldered connection.

SUMMARY OF THE INVENTION

To accomplish the foregoing and other objects and advantages of the present invention there is provided an earring post construction that is comprised of an elongated earring post and a cup that is for the support of a decorative piece. The elongated earring post and cup are integrally formed in a single piece construction so as to eliminate the use of any attachment means between the elongated earring post and the cup.

In accordance with other aspects of the present invention the elongated earring post has an annular recess for engagement with a securing stud; the elongated earring post and the cup are constructed of a precious metal material; the elongated earring post has an elongated passage; the elongated passage extends longitudinally at a center axis of the elongated earring post; the elongated earring post has a proximal end at the cup and a distal end formed by a blind end of the elongated passage; the elongated earring post has a proximal end at the cup and a distal end that is open to the elongated passage; the proximal end of the elongated earring post is one of open and closed; the proximal end of the elongated earring post is one of open and closed; the elongated earring post and the cup are constructed of a precious metal material; the elongated earring post has an elongated passage; and the elongated passage extends longitudinally at a center axis of the elongated earring post.

In accordance with another embodiment of the present invention there is provided an earring post construction that is comprised of an elongated earring post and a cup that is for the support of a decorative piece. The elongated earring post and cup is integrally formed in a single piece construction so as to eliminate the use of any attachment means between the elongated earring post and the cup; in combination with a securing stud that engages with the elongated earring post, and wherein there is provided an elongated passage in the elongated earring post so as to minimize the amount of precious metal used in constructing at least the elongated earring post.

In accordance with other aspects of the present invention the elongated earring post has an annular recess for engagement with the securing stud; both the elongated earring post and the cup are constructed of a precious metal material; the elongated earring post has a proximal end at the cup and a distal end formed by a blind end of the elongated passage; and the elongated earring post has a proximal end at the cup and a distal end that is open to the elongated passage.

In accordance with still another embodiment of the present invention there is provided a method of constructing an earring post construction comprising providing an elongated earring post and a cup that is for the support of a decorative piece, forming said elongated earring post and cup integrally in a single piece construction so as to eliminate the use of any attachment means between the elongated earring post and the cup; in combination with a securing stud that engages with the elongated earring post, and wherein there is provided an elongated passage in the elongated earring post so as to minimize the amount of precious metal used in constructing at least the elongated earring post.

In accordance with still other aspects of the present invention there is included providing the elongated earring post with an annular recess for engagement with the securing stud, and including constructing both the elongated earring post and the cup of a precious metal material.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 11:
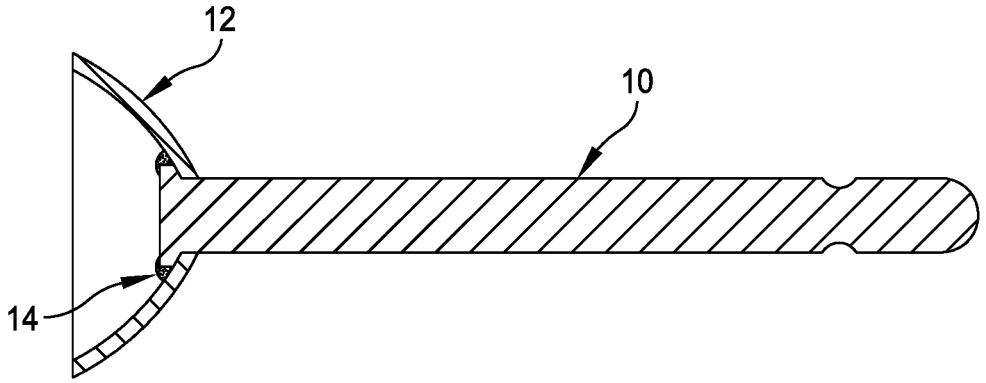
FIG. 11 (PRIOR ART)
FIG. 11 is a cross-sectional view of a prior art construction with an internal staking.
Figure 12:
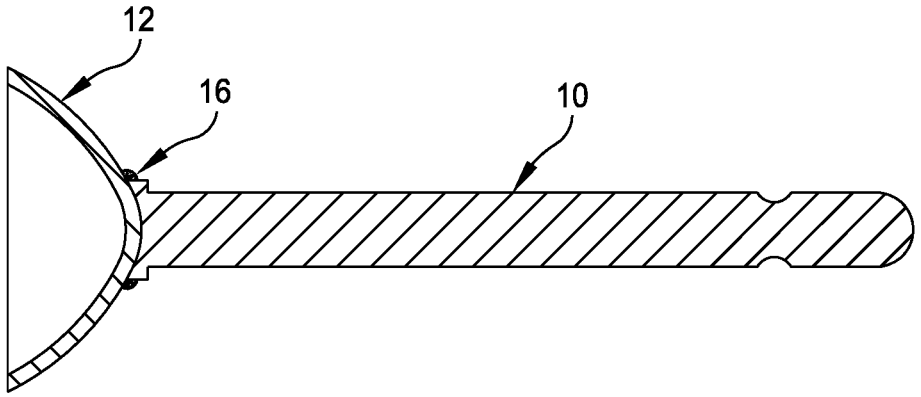
FIG. 12 (PRIOR ART)
FIG. 12 is a cross-sectional view of the prior art construction with an external staking.

Reference is now made in the drawings to FIGS. 1-5 that illustrate a first embodiment of the earring post construction of the present invention. This construction 20 is comprised of an elongated earring post 20 and a cup or pad 24 that is for the support of a decorative piece such as shown at 30 in FIGS. 6 and 7. In accordance with the present invention, rather than the construction illustrated in FIGS. 11 and 12, the elongated earring post and the cup are integrally formed in a single piece construction so as to eliminate the use of an attachment means between the elongated earring post and the cup or pad. This integral single piece construction is clearly illustrated in the cross-sectional view of FIG. 3.

Figure 1:
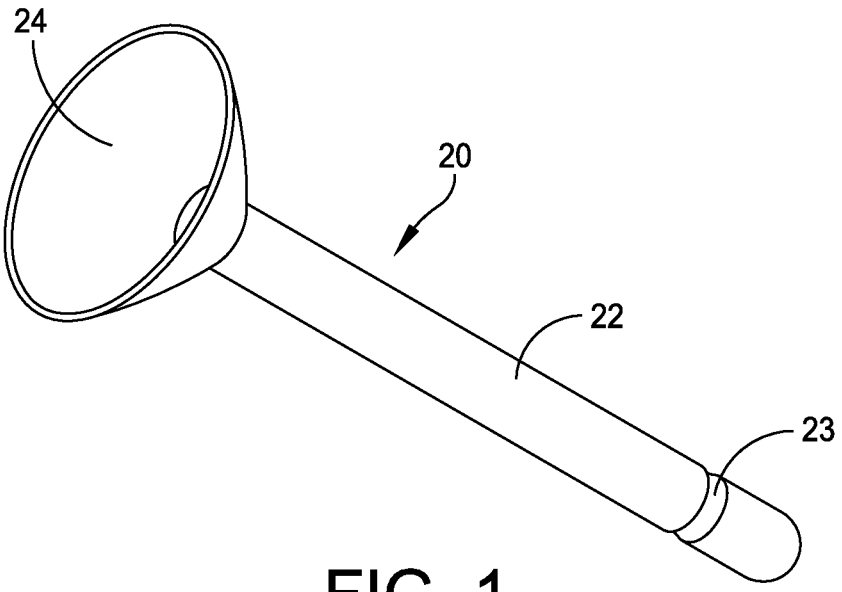
FIG. 1 is a perspective view of the earring post construction of the present invention.
Figure 2:
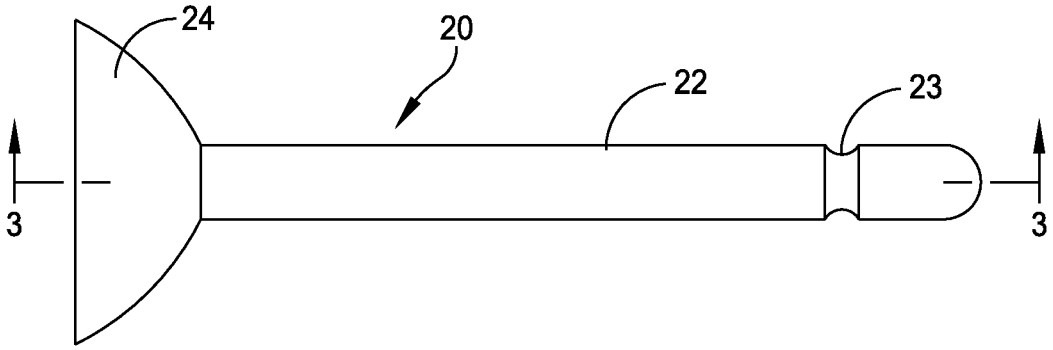
FIG. 2 is a side elevation view of the construction of FIG. 1.
Figure 3:
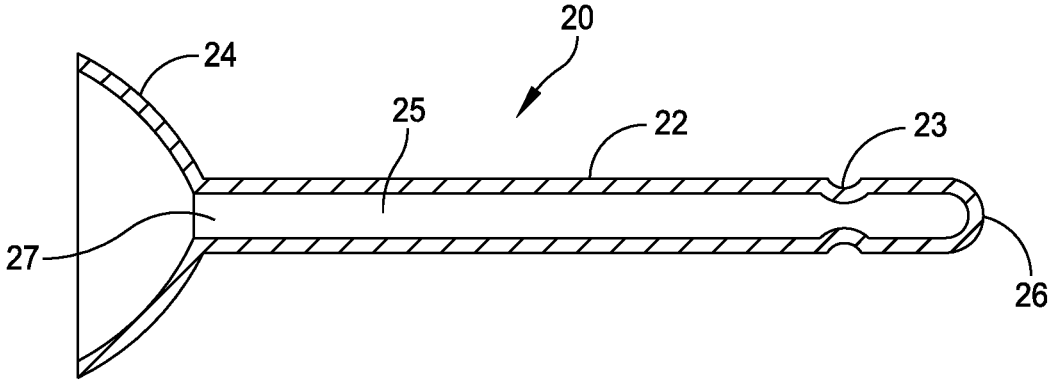
FIG. 3 is a cross-sectional view taken along line 3-3 of FIG. 2 and depicting the hollow passage within the post.
Figure 4:
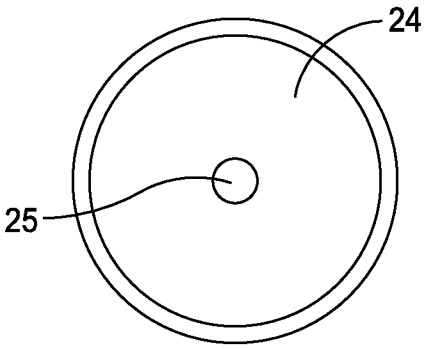
FIG. 4 is a left side view of FIG. 3.
Figure 5:
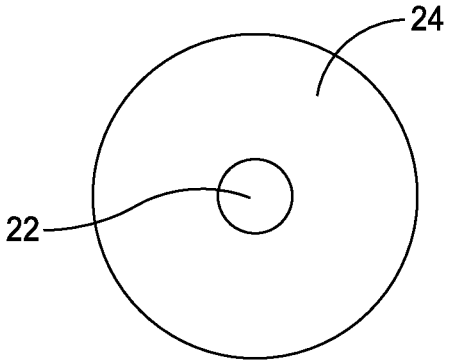
FIG. 5 is a right side view of FIG. 3.

In the first embodiment illustrated in FIGS. 1-5, the elongated earring post has an annular recess 23 close to a distal end of the post. This annular recess 23 is provided so as to enable engagement with a securing stud such as illustrated at 40 in FIGS. 6 and 7. Preferably, both the elongated earring post 20 and the cup or pad 24 are constructed of a precious metal material. In order to reduce as much as possible the precious metal, it is noted that the post 22 has an elongated hollow passage 25. The elongated hollow passage 25 extends longitudinally along a center axis of the elongated earring post. The elongated earring post may be considered as having a proximal end at the cup 24, and an embodiment of FIG. 3, at a distal end thereof the post 22 has a sealed or blind end indicated at 26 in FIG. 3. FIG. 3 also illustrates that, at the proximal end of the post 22, the forming with the cup or pad 24 is by means of an open end indicated at 27 in FIG. 3.

Figure 6:
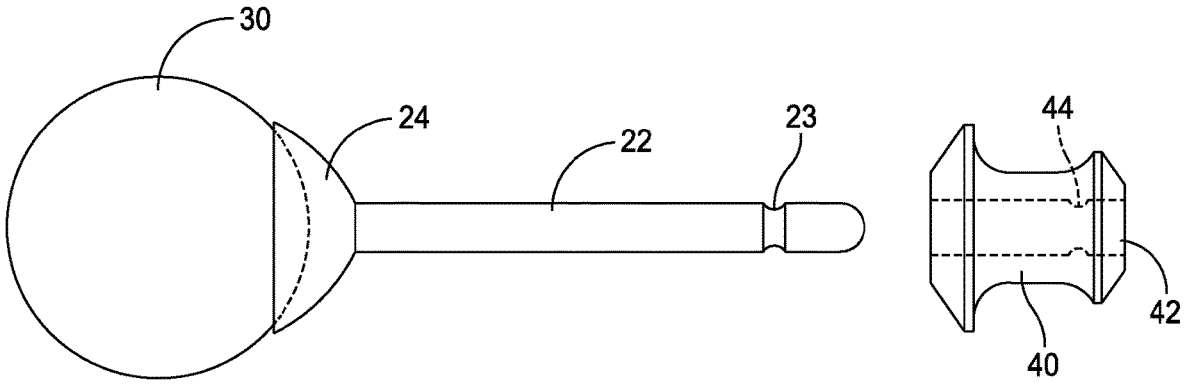
FIG. 6 illustrates the same post construction as depicted in FIG. 2 but furthermore illustrating the use of a back or stud for securing the post.
Figure 7:
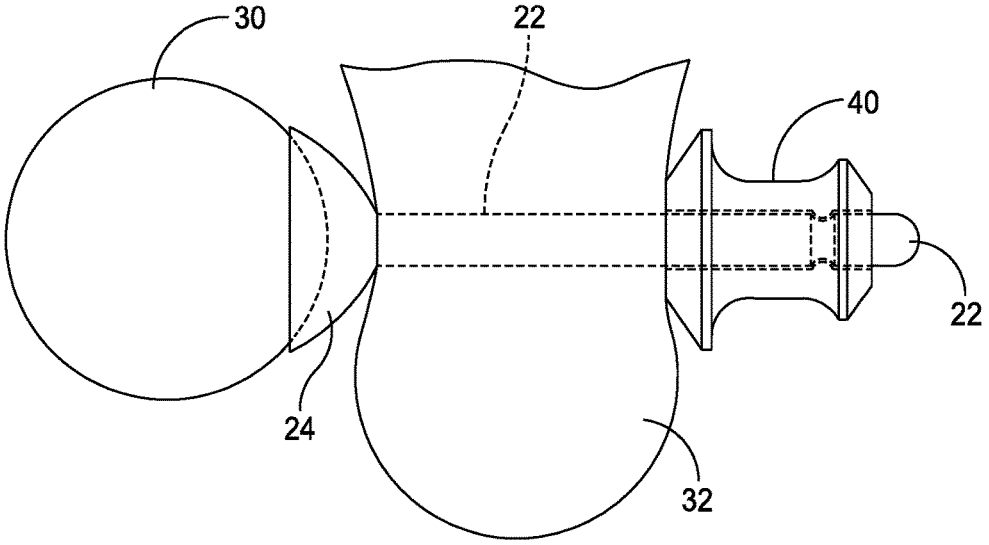
FIG. 7 is a view illustrating the back or stud in place on the post with the post passing through a pierced passage in the ear.

Reference is now made to FIGS. 6 and 7. FIG. 6 illustrates, in addition to the post and cup, the back or stud 40. The stud 40 may be of conventional design and includes a center passage 42 and an internal annular lip 44 that is for engagement with the post 22. FIG. 6 illustrates the back or stud 40 separated from the post 22 while FIG. 7 illustrates the back or stud 40 engaged with the post 22 so that the post earring construction is supported about the ear 32.

Figure 8:
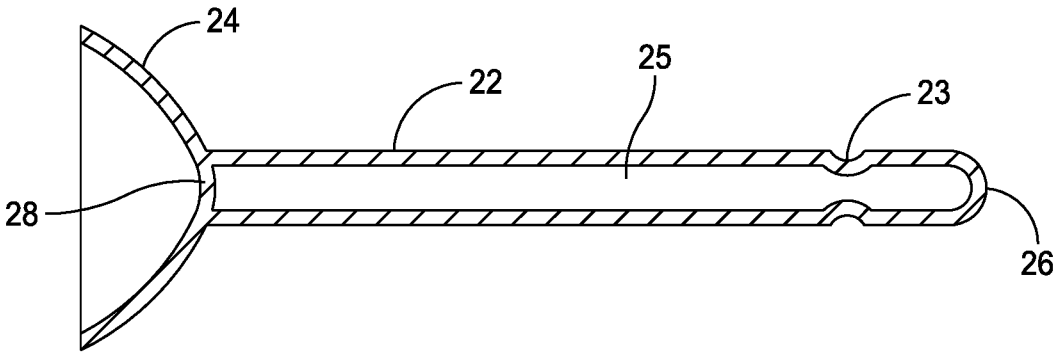
FIG. 8 is a cross-sectional view similar to that shown in FIG. 3 but further including the cup having an interconnecting wall.
Figure 9:
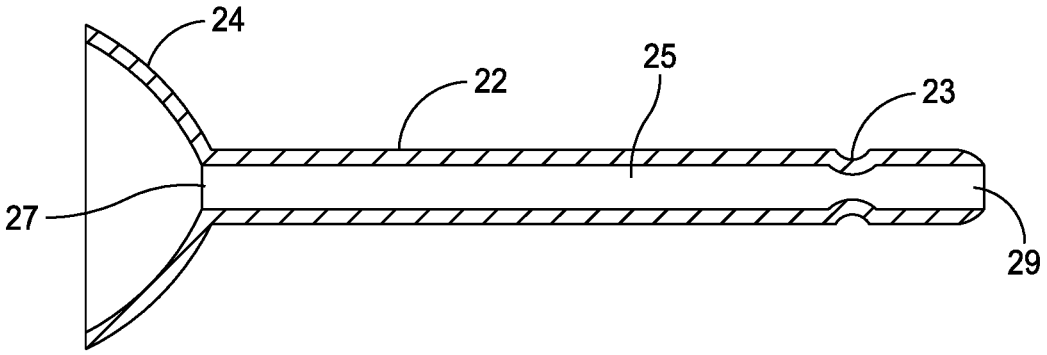
FIG. 9 is a cross-sectional view similar to that shown in FIG. 3 but further including the cup having an open distal end.
Figure 10:
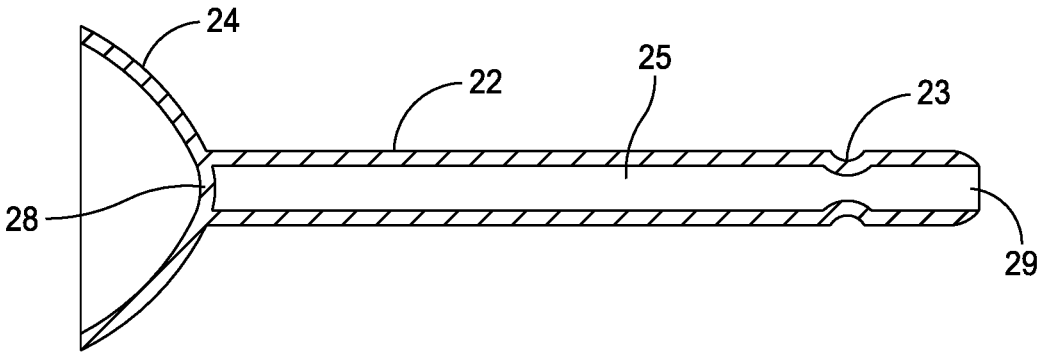
FIG. 10 is a cross-sectional view similar to that shown in FIG. 3 but further including the cup having an interconnecting wall and an open distal end.

Reference is now made to separate embodiments of the present invention illustrated in FIGS. 8, 9 and 10. As indicated previously, in the embodiment of FIG. 3 at the distal end of the support post 20 there is an enclosing wall 26 while at the proximal end there is an opening 27. In the cross-sectional view of FIG. 8, rather than having the post 22 open, it is closed by means of a wall 28. The wall 28 is essentially a continuation of the inner surface of the cup or pad 24.

The cross-sectional view of FIG. 9 illustrates the earring post as being opened at 29. Likewise, the cross-sectional view of FIG. 10 also depicts the earring post as open at 29. In FIG. 9 at the proximal end of the earring post it is also open as is indicated at 27 in FIG. 9. In the embodiment of FIG. 10, at the proximal end of the earring post, there is provided the wall 28 similar to the description relating to FIG. 8.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. An earring post construction that is comprised of an elongated earring post and a cup that is for the support of a decorative piece, said elongated earring post and cup being integrally formed in a single piece construction so as to eliminate the use of any attachment means between the elongated earring post and the cup;

wherein the elongated earring post has an elongated hollow passage wherein the elongated hollow passage extends longitudinally at a middle axis of the elongated earring post; and wherein the elongated earring post has a proximal end at the cup and a distal end that is open to the elongated passage.

2. The earring post construction of claim 1 wherein the elongated earring post has an annular recess for engagement with a securing stud.

3. The earring post construction of claim 2 wherein the elongated earring post and the cup are constructed of a precious metal material.

4. The earring post construction of claim 1 wherein the proximal end at the cup is formed by a wall.

5. The earring post construction of claim 4 wherein the wall is a continuation of an inner surface of the cup.

6. The earring post construction of claim 1 wherein the proximal end of the elongated earring post, at the cup, is open from the cup to the elongated hollow passage of the elongated earring post.

7. An earring post construction that is comprised of an elongated earring post and a cup that is for the support, of a decorative piece, said elongated earring post and cup being integrally formed in a single piece construction so as to eliminate the use of any attachment means between the elongated earring post and the cup;

wherein the elongated earring post has an annular recess for engagement with a securing stud:

wherein the elongated earring post and the cup are constructed of a precious metal material:

wherein the elongated earring post has an elongated hollow passage;

wherein the elongated hollow passage extends longitudinally at a center axis of the elongated earring post; and wherein the elongated earring post has a proximal end at the cup and a distal end that is open to the elongated passage.

8. An earring post construction that is comprised of an elongated earring post and a cup that is for the support of a decorative piece, said elongated earring post and cup being integrally formed in a single piece construction so as to eliminate the use of any attachment means between the elongated earring post and the cup; wherein there is provided an elongated hollow passage in the elongated earring post so as to minimize the amount of a precious metal used in constructing at least the earring post construction; wherein the elongated earring post has a proximal end at the cup and a distal end formed by a blind end of the elongated passage; and wherein the proximal end at the cup is open between the cup and the elongated hollow passage of the elongated earring post.

9. The earring post construction of claim 8 wherein the cup has an arcuate shape so as to define in interior area for the mounting of the decorative piece; and wherein the proximal end of the elongated earring post is open by virtue of an opening that is the same diameter as an inner diameter of the elongated earring post.

10. The earring post construction of claim 8 wherein the arcuate shape is a parabolic shape.

11. The earring post construction of claim 10 wherein, at the opening, there is an absence of any projection into the interior mounting area of the cup.

12. The earring post construction of claim 8 wherein the elongated earring post has an annular recess for engagement with the securing stud.

13. The earring post construction of claim 8 wherein both the elongated earring post and the cup are constructed of a precious metal material.

14. The earring post construction of claim 8 wherein the proximal end of the elongated earring post is open by virtue of an opening that is the same as an inner diameter of the elongated earring post.

15. An earring post construction that is comprised of an elongated earring post and a cup that is for the support of a decorative piece, said elongated earring post and cup being integrally formed in a single piece construction so as to eliminate the use of any attachment means between the elongated earring post and the cup; in combination with a securing stud that engages with the elongated earring post, and wherein there is provided an elongated hollow passage in the elongated earring post so as to minimize the amount of a precious metal used in constructing at least the earring post construction; and wherein the elongated earring post has a proximal end at the cup and a distal end that is open to the elongated passage.

* * * * *